US012098897B2

(12) United States Patent
Cortina

(10) Patent No.: US 12,098,897 B2
(45) Date of Patent: Sep. 24, 2024

(54) TUNER ATTACHED TO A MUZZLE BRAKE OR SUPPRESSOR OF A FIREARM

(71) Applicant: Erik Cortina, Floresville, TX (US)

(72) Inventor: Erik Cortina, Floresville, TX (US)

( * ) Notice: Subject to any disclaimer, the term of this patent is extended or adjusted under 35 U.S.C. 154(b) by 0 days.

(21) Appl. No.: 18/289,404

(22) PCT Filed: May 4, 2022

(86) PCT No.: PCT/US2022/027643
§ 371 (c)(1),
(2) Date: Nov. 3, 2023

(87) PCT Pub. No.: WO2022/235776
PCT Pub. Date: Nov. 10, 2022

(65) Prior Publication Data

US 2024/0240901 A1 Jul. 18, 2024

Related U.S. Application Data

(60) Provisional application No. 63/183,850, filed on May 4, 2021.

(51) Int. Cl.
*F41A 21/38* (2006.01)
*F41A 21/30* (2006.01)

(52) U.S. Cl.
CPC ..... *F41A 21/38* (2013.01); *F41A 21/30* (2013.01)

(58) Field of Classification Search
CPC ..... F41C 27/22; F41A 21/00; F41A 21/30; F41A 21/32; F41A 21/38
USPC ..... 89/14.05
See application file for complete search history.

(56) References Cited

U.S. PATENT DOCUMENTS

2016/0334181 A1* 11/2016 Bennington ..... F41A 21/32
2021/0404760 A1* 12/2021 Hipp ..... F41A 21/36
2023/0175803 A1* 6/2023 Wragg ..... F41A 21/32
89/14.05

FOREIGN PATENT DOCUMENTS

EP 0777099 A2 * 6/1997

* cited by examiner

*Primary Examiner* — Samir Abdosh
(74) *Attorney, Agent, or Firm* — J. Andrew Reed; Think Differently Legal, PLLC

(57) ABSTRACT

A muzzle brake having a tuner and allowing for micro-adjustments to the weight of the barrel of a firearm. Upon being fired, the weighted the barrel mitigates the effect on aiming by disruptive frequencies reverberating through the firearm. The muzzle brake can incorporate a muzzle brake and be positioned after the muzzle brake segment such that the harmonics of the muzzle brake segment can also be affected by the muzzle brake. Use of the tuner on a firearm can increase overall accuracy and affect the groupings of shots on target when compared to use of a firearm without a muzzle brake.

20 Claims, 6 Drawing Sheets

TUNER ATTACHED TO A MUZZLE BRAKE OR SUPPRESSOR OF A FIREARM

BACKGROUND

Cross-Reference to Related Applications

This application is a U.S. National Stage of International Application No. PCT/US2022/027643 filed on May 4, 2022 entitled "Tuner Attached to a Muzzle Brake or Suppressor of a Firearm" published as WO 2022/235776 on Nov. 10, 2022, which claims the benefit of U.S. Provisional Application No. 63/183,850, filed May 4, 2021 entitled "Tuner Attached to a Muzzle Brake or Suppressor of a Firearm," the disclosures of which are incorporated herein by reference.

TECHNICAL FIELD

The present disclosure relates to firearm muzzle attachments. More particularly, and not by way of limitation, the present disclosure is directed to a tuner that allows for increased accuracy and tighter groupings on targets when utilizing firearms.

BACKGROUND

This background section is intended to provide a discussion of related aspects of the art that could be helpful to understanding the embodiments discussed in this disclosure. It is not intended that anything contained herein be an admission of what is or is not prior art, and accordingly, this section should be considered in that light.

A firearm is a common tool that has been around in some form for centuries and allows for the operator to engage a target that is some distance away from the operator with a projectile. A combustible powder is ignited in the chamber of the firearm which produces a gas as it burns. The increase in gas causes an increase in pressure in the chamber and creates a force to push the projectile down the barrel of the firearm. The projectile is propelled out the end of the firearm that is pointed away from the operator, toward the intended target. Ideally, the projectile strikes the target after traversing the distance between the operator and the target.

A successful strike on the target is not guaranteed, however, and the further the distance is between the operator and the target, the greater the potential to miss the target. There is a myriad of factors that can cause the projectile to miss the target. Some of these factors are derived from operator error. Improper breathing and flinching while firing are common causes of missed targets resulting from operator error. Another reason that a projectile may miss its target is the result of the firing process itself. When the powder is ignited and begins exerting a force on the projectile to push it down the barrel of the firearm, a second force pushes in the opposite direction, driving the rear portion of the firearm against the operator. This opposite force results recoil and can cause the muzzle of the firearm to waiver off target before the projectile leaves the barrel. Muzzle brakes, which are attachments placed on the end of the barrel, contain one or more vents or ports which direct the gases escaping the barrel in such a way as to mitigate the movement of the barrel caused by the firing of the firearm.

Another source of error is a result of vibrations caused by the firing process itself and transmitted into then entire firearm, including the barrel. One way to dampen the effects of these vibrations is to attach a weight or dampening material to the barrel at the proper position to dampen these vibrations. The position of the weight or dampening material should be based on the barrel characteristics, the type and amount of powder, the weight and composition of the bullet, and the weight and tolerances of the gun or firearm as a whole. The reason for this is the harmonics created with the vibrations should be minimized to allow for the most accurate shot.

It would be advantageous to have a tuner that overcomes the disadvantages of the prior art.

BRIEF SUMMARY

This summary provides a discussion of aspects of certain embodiments of the invention. It is not intended to limit the claimed invention or any of the terms in the claims. The summary provides some aspects but there are aspects and embodiments of the invention that are not discussed here.

The present disclosure includes a muzzle brake that can be attached to the end of the barrel of a firearm, wherein the muzzle brake may comprise a self-timing nut and a tuner. The muzzle brake can have two sets of external threads. The first set of threads located on a first end (also called the proximate end) can allow for a self-tuning nut to be attached to the muzzle brake. On the other side of the muzzle brake, a tuner may be attached to a muzzle brake by being threaded on to a second set of external threads (also called distal threads) located on the distal end of the muzzle brake. The self-timing nut and the tuner can be positioned such that the muzzle ports of the muzzle brake are located between the tuner and the self-timing nut. At least one or more ports are positioned along the muzzle brake to allow for the direction of gases escaping the barrel. Utilizing a self-timing nut on the barrel side set of threads, the tuner can be attached to the muzzle brake on the opposite side away from the barrel of the firearm and oriented so that the ports of the muzzle are facing the proper direction to direct gases expelled from the firearm. By making fine adjustments with the tuner, an operator can alter the center of gravity for the barrel of the firearm through the weight of the tuner to mitigate the effects of vibrations caused by the firing process.

BRIEF DESCRIPTION OF THE DRAWINGS

The novel features believed characteristic of the disclosure are set forth in the appended claims. The disclosure itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1A:
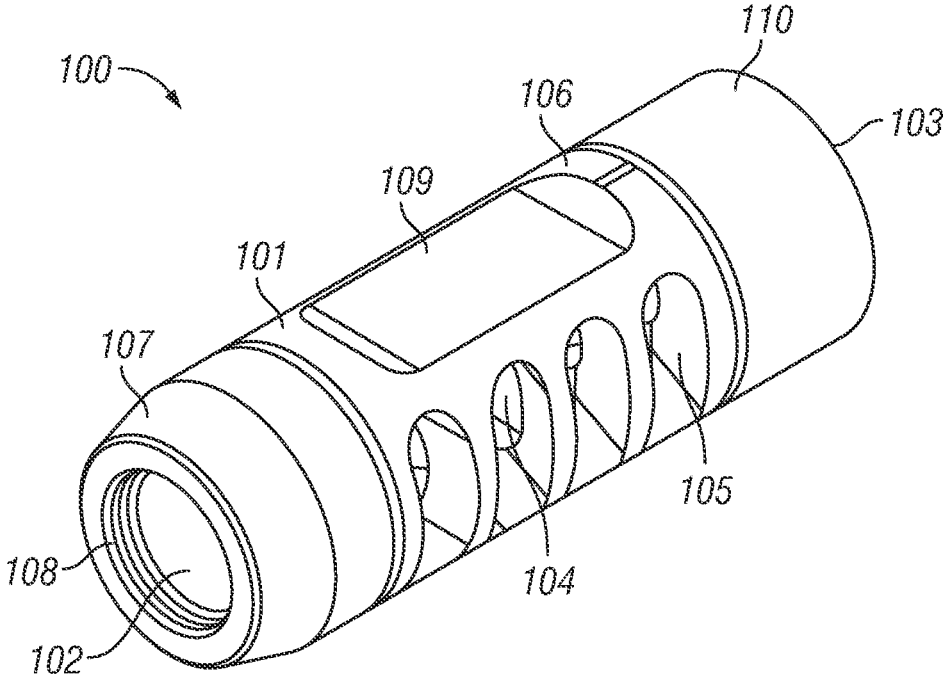
FIG. 1A is a perspective view of an illustrative embodiment of a muzzle brake with self-timing nut and tuner affixed.

A firearm operates by igniting a powder located behind a projectile that is housed in a chamber and pointed toward the bore of a barrel that has an opening at the end of it. As the powder burns, gas is emitted, creating an increase in pressure in the chamber. The increase in pressure pushes the projectile down the bore of the barrel, towards the opening at the end. Typically, the barrel of most firearms is rifled. As the projectile traverses through the barrel, it rotates radially with the direction of the rifling in the barrel. Once the projectile exits the end of the barrel, it continuously moves in the direction that the barrel was pointed. Modern rifles allow for cartridges to be used that house the projectile, powder, a firing charge or primer, and optionally a buffer or wad material between the powder and the projectile or bullet.

A muzzle brake is a common attachment to the barrel of a firearm that can affect the recoil and accuracy of a firearm when fired. Typically, a muzzle brake has one or more vents strategically arranged to divert propellant gas responsible for the projectile being directed down the horizontal length of the barrel. As the projectile leaves the barrel, it simultaneously enters the muzzle brake that is positioned coaxially with the barrel. The projectile and the propellent gases are then ejected out the end of the barrel in the direction that the barrel is pointed. Propellant gas is diverted through the ports or vents, causing a force to be exerted on the muzzle and dampen the movement of the barrel. At several stages of the firing process, including combustion of the powder, the movement of the projectile and gases through the barrel, and the ejection of the projectile and propellant gases out the end of the firearm can cause vibrations to move through the firearm, potentially causing error in the aiming process. In particular, if the muzzle brake gas ports are not positioned correctly then the barrel vibrations can cause shifts in the trajectory of the bullet or projectile.

There are at least four types of vibrations that can cause significant error in the projectile's trajectory when it exits the firearm out of the barrel: longitudinal vibration, radial vibration, torsional vibration and bending vibration. Longitudinal vibrations are caused by the stretching and contracting of the barrel. Radial vibrations are caused by periodic movement, expansion, and contraction of the barrel bore. Torsional vibration is caused by the projectile twisting while it traverses through the bore of the barrel as a result of the rifling that lines the interior surface of bore of the barrel.

Bending vibrations are associated with two types of errors: aiming error and muzzle flip. For aiming error, the barrel on the firearm has a focal point (sometimes called a nodal point) which the barrel bends about. The closer the focal point is to the muzzle, the less aiming error is present. Dependent on the frequency of the vibration, the time it takes for the projectile to exit the barrel, and the length of the barrel, the only point along the barrel not bending is the focal point. Change the frequency of the vibration and the focal point is changed. Shorter barrels have higher frequencies over longer barrels.

For muzzle flip, the muzzle is moving radial at a frequency which results in a radial acceleration and velocity which, because of inertia, is transferred to the projectile as it exits the muzzle. The tuner brake described herein allows for minute adjustments (for example, as little as 0.002 inches) to be made to the barrel length which alters when, in the periodic motion process, the projectile exits the muzzle. If the projectile can be timed to exit the barrel when the barrel has ceased movement in order to prevent a change of direction, then radial or other acceleration forces are no longer present, eliminating bullet or projectile deflection.

A tuner can allow for the dampening of vibrations, harmonics, and introduce weight to a firearm in a manner that allows for increased accuracy and performance that are caused by the gases and movements of the bullet or projectile within the barrel. One way to dampen the effects of these vibrations is to attach a tuner brake to the barrel of the firearm. A tuner brake allows for the weight of the barrel to be adjusted such that the center of gravity for the firearm is altered longitudinally along the barrel. However, tuner brakes often require special tools to install or require skills in placement to determine which vibrations or harmonics need to be dampened. Tuners were attached to the barrel and positioned before the muzzle brake, which meant that the frequencies in the muzzle brake caused by the firing process were not compensated for. Only a professional gunsmith possessed the requisite skill, knowledge and tools to install and tune the tuner properly.

Therefore, what is needed is a tuner attached to the end of a muzzle brake, suppressor, or any other muzzle device on the opposite side of the barrel that can be installed and tuned by an ordinary operator without special tools. In some embodiments, the tuner may be threaded for attachment and may resemble a nut; however, in other embodiments the tuner may be attached by other means and may not resemble a nut. Examples of non-threaded attachment is through friction fit, tongue and groove, dovetail, channel and pin, and/or gravity based connections. Both the self-timing nut and the tuner, in some but not all embodiments, may be locked into to place and unlocked with ease to allow for quick adjustment by the operator.

An embodiment of the disclosure will be described. FIG. 1A is a perspective view of an illustrative embodiment of a muzzle brake 100 (also called a tuner brake) with self-timing nut 107 and tuner 110 affixed. The muzzle brake 100 may have a cylinder 101 and an inner bore 104 that allows for a projectile to enter through a first aperture 102 (also called the proximate aperture) located on a proximate end of the muzzle brake 100, traverse the entire longitudinal length of the cylinder 101, and exit a second aperture 103 (also called distal aperture) on the opposite side of the muzzle brake 100 located on the distal end. The second aperture 103 is coaxial with the first aperture 102 and the tuner bore 104. A muzzle brake segment 106 may be integral to the muzzle brake and possess one or more muzzle ports 105 located along the exterior wall or exterior circumference of the cylinder 101, which allow access to the inner tuner bore 104. Each muzzle port 105 of the muzzle brake segment 106 may be configured to direct gases exiting the muzzle of the barrel of the firearm (not shown) in a particular direction to push the barrel in such a way that movement of the barrel is mitigated.

A self-timing nut 107 may be threaded onto a first set of exterior threads (not shown) (also called proximate threads) on the side closest to the barrel of the firearm. The self-timing nut 107 allows for the muzzle brake 100 to be threaded onto the barrel of a firearm with an interior threading 108 on the inner surface of the self-timing nut 107. By threading on the inner threading 108 onto the matching threads on the barrel of the firearm, then adjusting the self-timing nut 107 so that the wrench flats 109 may be oriented facing upward, the muzzle brake 100 can be secured to the barrel of the firearm. Additionally, this is allows for the one or more muzzle ports 105 to be aligned in a manner that allows gas to exit in a horizontal orientation. One or more embodiments may feature the self-timing nut 107 attached, however, other embodiments may not feature a self-timing nut at all as it may not be necessary for the muzzle brake 100 to functional properly. For example, if a radial brake (a brake with muzzle ports located all around the circumference of the brake so that gas is vented generally and not in any one or more specific direction) is used, then timing the radial brake may not be necessary because orientation of the muzzle ports in a particular direction may not produce a benefit to the operator.

On the opposite end of the muzzle brake 100, a tuner 110 can be threaded onto a second set of exterior threads (not shown) (also called distal threads). The tuner 110 may have indicators equidistantly spaced from each other that radially encircle the exterior surface of the tuner 110. By making minute adjustments to the tuner 110, the center of gravity of the entire firearm may be adjusted and finely tuned. The placement of the tuner 110 after the muzzle brake segment 106, allows for the internal harmonics of the muzzle brake segment 106 to be accounted for when tuning the tuner 110. In at least one embodiment, the tuner 110 is weighted to match various firearm barrels or configurations. For example, a heavier competition barrel may require the tuner 110 to be heavier than on a light-weight youth model firearm which would utilize a lighter tuner 100 to prevent the over correction of bullet or projectile trajectory. Alternate embodiments of the muzzle brake 100 can have the tuner affixed to the first end (also called the proximate end) of the muzzle brake 100, and the self-timing nut affixed to the second end (also called the distal end) of the muzzle brake 100, meaning the self timing nut and the tuner nut, as well as their corresponding threads, switch places on the muzzle brake 100.

Figure 1B:
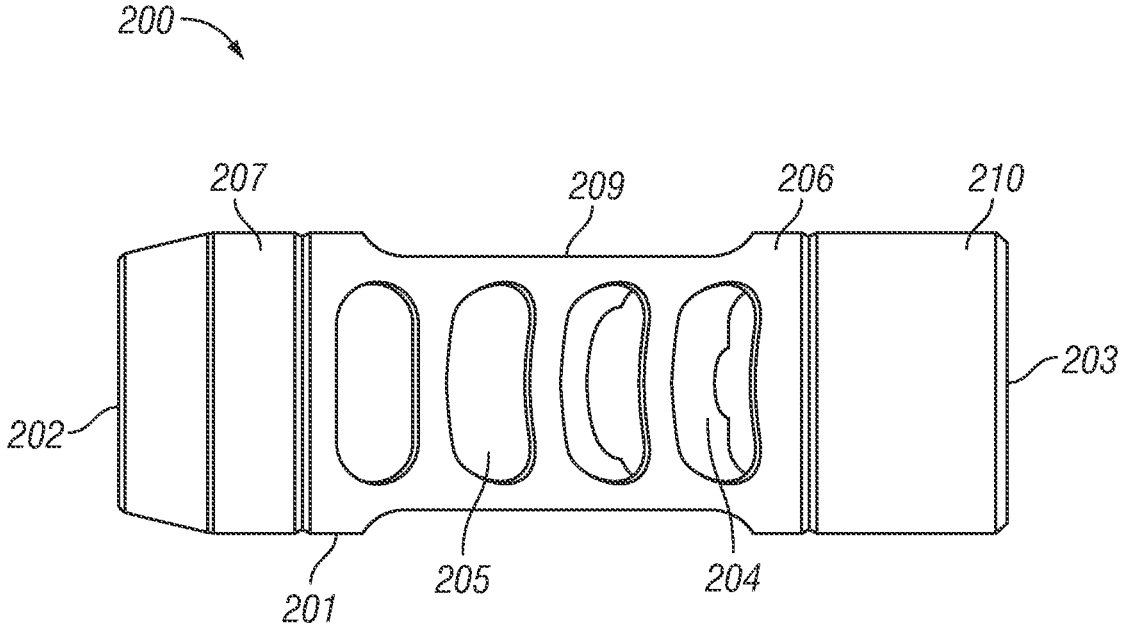
FIG. 1B is a side view of an illustrative embodiment of the muzzle brake with self-timing nut and tuner affixed.

FIG. 1B is a side view of an illustrative embodiment of the muzzle brake 200 (also called a tuner brake) with self-timing nut 207 and tuner 210 affixed. The cylinder's 201 first aperture 202 (also called proximate aperture) located on a proximate end may be coaxial with the bore of a barrel on a firearm (not shown). A projectile that exits the bore of the barrel may enter into the interior space of the cylinder called the tuner bore 204 and exit the opposite side through the second aperture 203 (also called distal aperture) located on a distal end. The gases that propel a projectile out of the bore of the barrel and into the muzzle brake may be at least partially directed through one or more muzzle ports 205 positioned along the exterior of the cylinder 201. The shape of the one or more muzzle ports 205 can be important as it can cause different positioning or orientation of gas exiting the barrel or muzzle brake segment 206. Rounding, or squaring of corners of the one or more muzzle ports 205 can allow for flaring or directing of opposing forces on a barrel and subsequently the bullet or projectile. After connecting the muzzle brake 200 to the barrel of the firearm, a self-timing nut 207 may be utilized to orient and secure the muzzle brake 200 into the desired position. Ideally, but not required, the wrench flat 209 may be positioned facing upward or allow for a level or other guide to be placed horizontally across the wrench flat 209. At the end of the muzzle brake 200 opposite the side connected to the barrel, a tuner 210 may be threaded onto the muzzle brake 200. Adjusting the tuner 210 allows for small adjustments to be made to the length and weight of the barrel (not shown), and this modifies the harmonic frequencies resonating through the muzzle brake 200. Alternate embodiments of the muzzle brake 200 may have the tuner 210 affixed to the first end (also called the proximate end) of the tuner brake 200, and the self-timing nut 207 affixed to the second end (also called the distal end) of the muzzle brake 200.

Figure 1C:
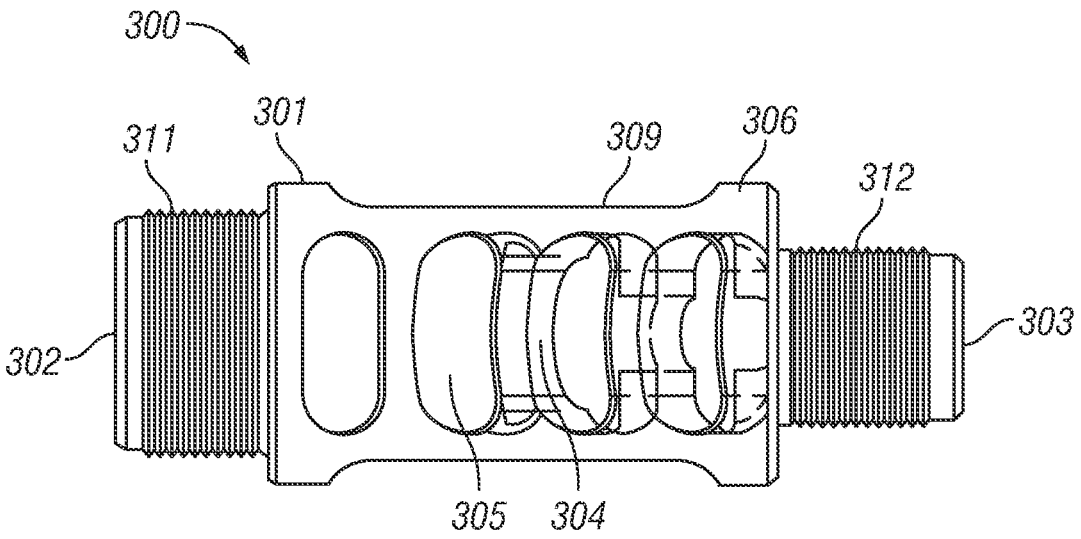
FIG. 1C is a side view of an illustrative embodiment of a muzzle brake with self-timing nut threads and tuner threads exposed.

FIG. 1C is a side view of an illustrative embodiment of a muzzle brake 300 (also called a tuner brake) with self-timing nut threads 312 and tuner threads 311 exposed. The tuner bore 304 of the cylinder 301 allows traversal from the first aperture 302 (also called proximate aperture), located on a proximate end, to the second aperture 303 (also called distal aperture), located on the distal end, of the muzzle brake 300. Muzzle ports 305 along the exterior of the cylinder 301 allow access to the tuner bore 304. The wrench flat 309 is located along the muzzle brake 306. A first set of threads 312 (also called proximate threads) are positioned along the exterior of the cylinder 301 on the end of the muzzle brake 300 near the first aperture 302 (also called proximate aperture). The first set of threads 312 (also called proximate threads) allow for a self-timing nut (not shown) to be threaded onto the muzzle brake 300 and utilized to secure the muzzle brake 300 to a firearm barrel. On the opposite side, a second set of threads 311 (also called distal threads) allow for a tuner (not shown) to be secured to the muzzle brake 300 in line with the muzzle brake segment 306. Alternate embodiments of the muzzle brake 300 may have the first set of threads on the distal end of the muzzle brake 200, and the second set of threads on the proximate end of the muzzle brake 300.

Figure 1D:
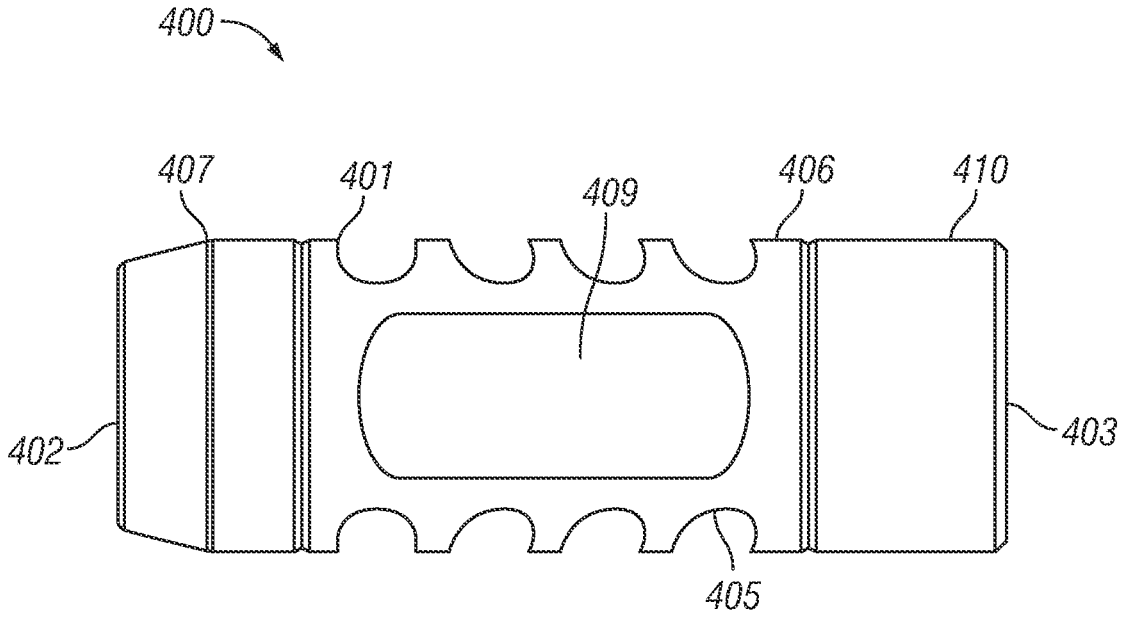
FIG. 1D is a top view of an illustrative embodiment of a muzzle brake with self-timing nut and tuner affixed.

FIG. 1D is a top view of an illustrative embodiment of a muzzle brake 400 (also called a tuner brake) with self-timing nut 407 and tuner 410 affixed. The cylinder 401 may have a first aperture 402 (also called proximate aperture) located on the proximate end that allows a projectile to enter a tuner bore (not shown) and exit the muzzle brake through a second aperture 403 (also called distal aperture) located on the distal end. One or more muzzle ports 405 are positioned along the exterior of the muzzle brake segment 406 and are roughly perpendicular to the wrench flat 409. A self-timing nut 407 may be positioned on one side adjacent to a barrel of a firearm (not shown) and a tuner 410 may be connected on the opposite side of the muzzle brake 400.

By orienting the tuner 410 in line with or in front of the muzzle ports 405 of the muzzle brake 400 such that the tuner 410 is affixed on the side of the firearm opposite the barrel of the firearm, the muzzle brake 400, and consequently the tuner 410 may be smaller and weigh less. This is due to the extra leverage provided by being at the very tip of the firearm. Orienting the muzzle brake 400 so that the tuner 410 is at the very tip, moves the center of gravity of the entire firearm further toward the barrel end of the firearm than it would otherwise be if the tuner 410 was positioned inbetween the barrel of the firearm and the muzzle brake segment 406. Because less weight is needed, smaller adjustments can be made to the tuner 410 that have a greater impact on the center of gravity of the firearm. In other words, the placement of the tuner 410 on the muzzle brake 400 at the very tip of the firearm so that the muzzle brake segment 406 is in between the tuner 410 and the bore of the barrel, more minute and finer adjustments can be made to the weight of the barrel, giving the operator more control when it comes to tuning the firearm for precision firing. Additionally, the muzzle brake 400 may be made smaller which can in turn be more aesthetically appealing as compared to having the tuner 410 in between the muzzle brake segment 406 and the firearm's barrel. Furthermore, orienting the muzzle brake 400 so that the tuner is affixed in between the firearm's barrel and the muzzle brake segment 406 may also interferes with the self-timing nut 407, complicating its function.

However, alternate embodiments of the muzzle brake 400 may have the tuner 410 affixed to the first end (also called the proximate end) of the muzzle brake 400, and the self-timing nut 407 affixed to the second end (also called the distal end) of the muzzle brake 400, so that the tuner 410 is between the barrel of the firearm and the muzzle brake segment 406.

Figure 2A:
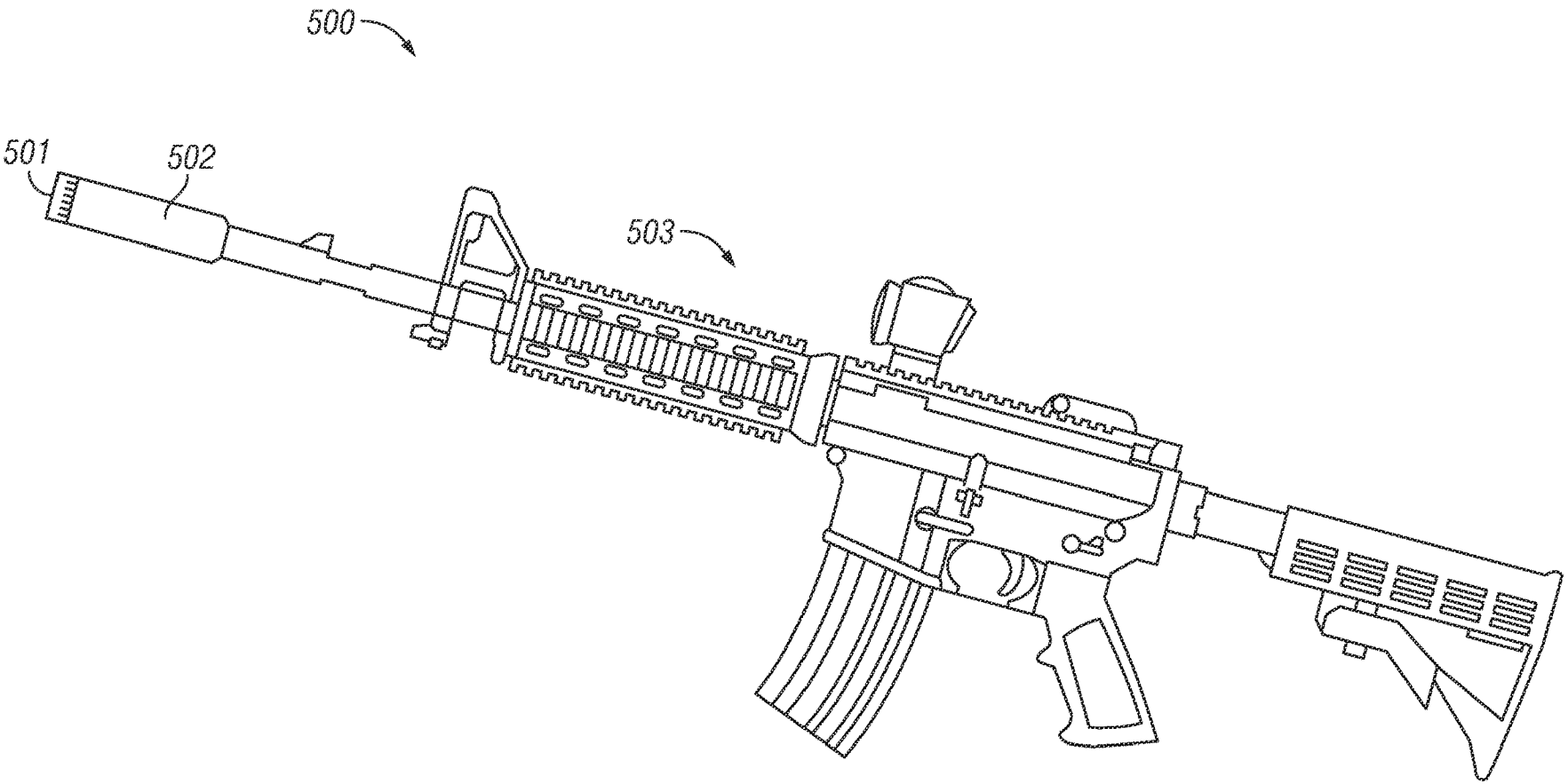
FIG. 2A is an environmental view of a firearm assembly with a tuner attached to a suppressor for a rifle.

FIG. 2A is an environmental view of a firearm assembly 500 with a tuner 501 attached to a suppressor for a rifle 503 (collectively the tuner 501 and suppessor 502 together may be called an attachment). A rifle 503 may have a suppresser 502 attached to the tip of the rifle's 503 barrel. The suppressor 502 may be in line with tuner 501 that is attached at the end. The tuner 501 allows for fine adjustments to the center of gravity of the firearm 503. As depicted in FIG. 2A, the suppressor is in line between the barrel of the firearm 503 and the tuner 501. Other embodiments may also include the tuner 501 in front of the suppressor 502 between the barrel of the firearm and the suppressor 502. Initial research may indicate that there are some benefits from having the tuner 501 in front of the suppressor 502. Another embodiment comprises the addition of a self-timer nut in line with the barrel, suppressor, and tuner. In some examples, the tuner 501 may also allow for adjustments of the internal baffles of the suppressor to adjust the noise, or gas dampening profile. Similarly, if a liquid is utilized as part of the suppressor 502, then the tuner 501 may allow for adjustment of transfer of liquid within the suppressor 502.

Figure 2B:
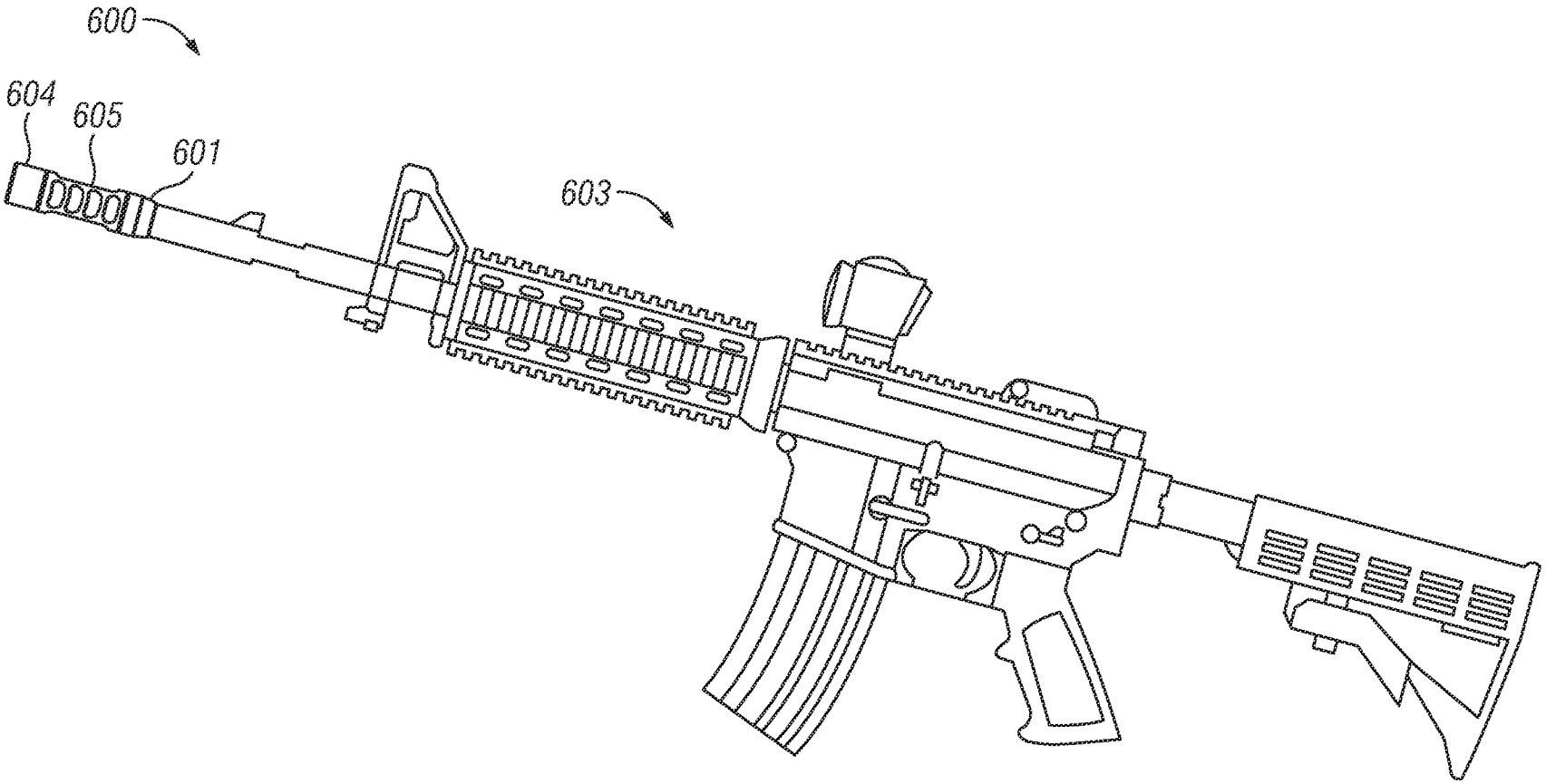
FIG. 2B is an environmental view of a firearm assembly with a tuner in line with a muzzle brake for a rifle.

FIG. 2B is an environmental view of a firearm assembly 600 with a tuner 604 in line with a muzzle brake 605 for a rifle. A rifle 603 may have a tuner 604 in line with and incorporate a muzzle brake 605, attached to the barrel of the rifle 603 in line with a self-timing nut 601. The muzzle brake 605 may have a cylinder and an inner bore that allows for a projectile to enter through a first aperture (also called proximate aperture), traverse the entire longitudinal length of the cylinder, and exit a second aperture (also called distal aperture) on the opposite side of the muzzle brake 605 that is coaxial with the first aperture and the tuner bore. A muzzle brake 605 may possess one or more integral muzzle ports located along the exterior wall of the cylinder, which allow access to the inner tuner bore. Each port of the muzzle brake 605 may be configured to direct gases exiting the muzzle of the barrel of the firearm (not shown) in a particular direction to push the barrel in such a way that movement of the barrel is mitigated.

A self-timing nut may be threaded onto a first set of exterior threads (not shown) (also called proximate threads) on the side closest to the barrel of the firearm. The self-timing nut allows for the muzzle brake to be threaded onto the barrel of a firearm with an interior threading on the inner surface of the self-timing nut. By threading on the inner threading onto the matching threads on the barrel of the firearm, then adjusting the self-timing nut 601 so that the wrench flats may be oriented facing upward, the muzzle brake 605 can be secured to the barrel of the firearm. Additionally, this is allows for the one or more muzzle ports to be aligned in a manner that allows gas to exit in a horizontal orientation.

On the opposite end of the muzzle brake, a tuner 604 can be threaded onto a second set of exterior threads (not shown) (also called distal threads). The tuner 604 may have indicators equidistantly spaced from each other that radially encircle the exterior surface of the tuner 604. By making minute adjustments to the tuner, the center of gravity of the entire firearm may be adjusted and finely tuned. The placement of the tuner 604 after the muzzle brake 605 allows for the internal harmonics of the muzzle brake 605 to be accounted for when tuning the tuner 604. In at least one embodiment, the tuner 604 is weighted to match various firearm barrels or configurations. For example, a heavier competition barrel may require the tuner 604 to be heavier than on a light-weight youth model firearm which would utilize a lighter tuner 604 to prevent the overcorrection of bullet or projectile trajectory. Alternate embodiments of the muzzle brake 605 may have the tuner 604 affixed to the second end (also called the distal end) of the muzzle brake 605, and the self-timing nut 601 affixed to the first end (also called the proximate end) of the muzzle brake 605.

Figure 3A:
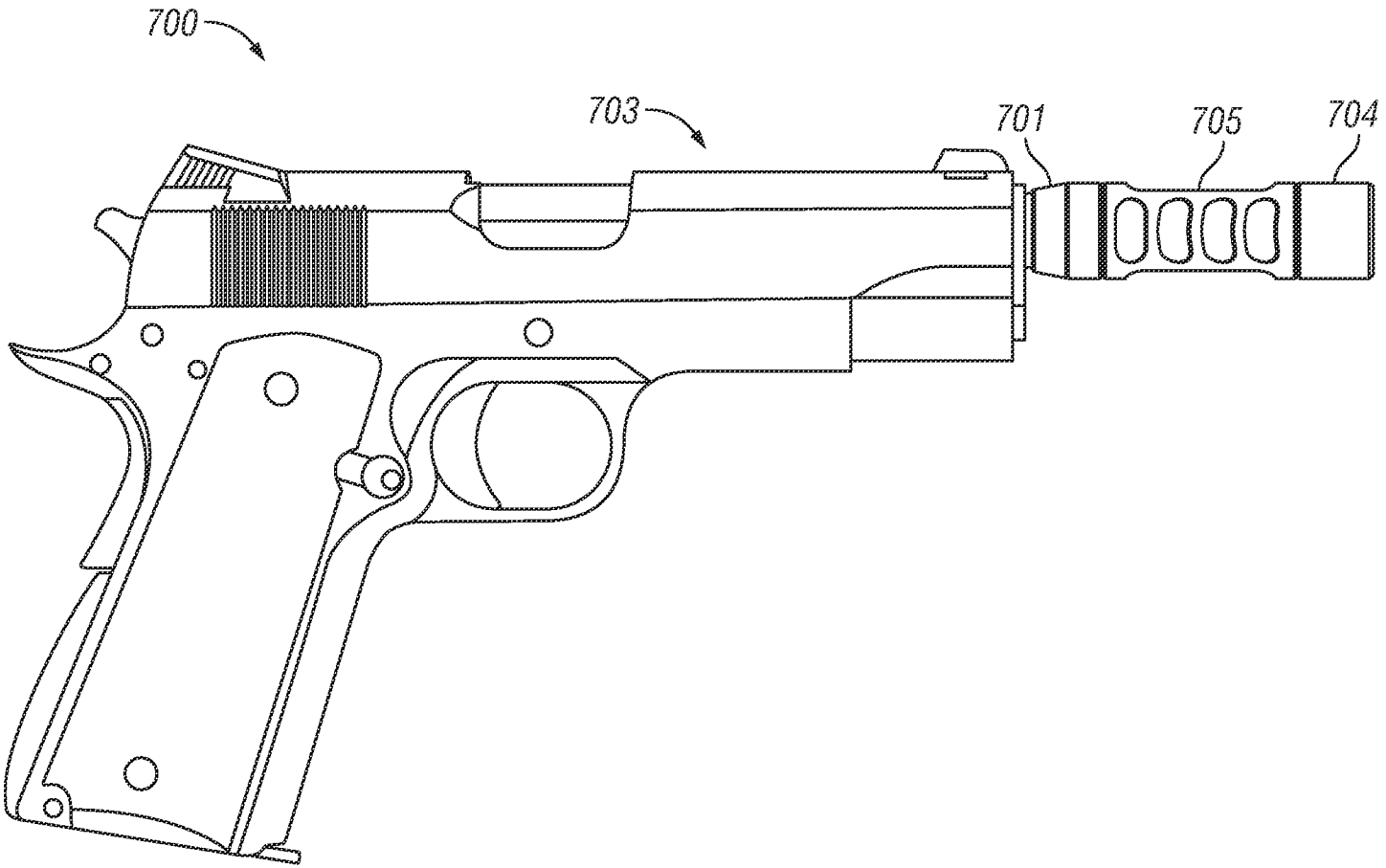
FIG. 3A is an environmental view of a firearm assembly that incorporates a tuner in line with a muzzle brake for a pistol.

FIG. 3A is an environmental view of a firearm assembly 700 that incorporates a tuner 704 in line with a muzzle brake for a pistol 703. Attached to the barrel of the pistol 703 in line with a self-timing nut 701, a pistol 703 may have a tuner 704 in line with a muzzle brake segment 705, The operator (not shown) may engage the pistol 703 to propel a projectile by the force created from the expansion of gases inside the chamber (not shown) out the barrel of the pistol 703. With the self-timing nut 701, a tuner 704 that incorpoporates a muzzle brake 705 with the tuner 704 that may engage with the end of the barrel of the pistol 703 so that the tuner is inline with the bore (not shown) of the pistol 703. A projectile that exits from the bore of the pistol 703 enters the muzzle brake segment 705 and the proceeds through the tuner 704 that has been threaded (not shown) onto the a set of matching threads on the tuner. Fine adjustments on the tuner 704 can tune the pistol 703, so that the internal frequencies of the firing process revirbirating through the pistol 703 and the muzzle brake segment 705 of the tuner. As a result, the grouping of the projectiles striking the intended target (not shown) may be affected in a positive maner—e.g., the grouping may be tighter than it would have otherwise been without the presence of a tuner 704.

Figure 3B:
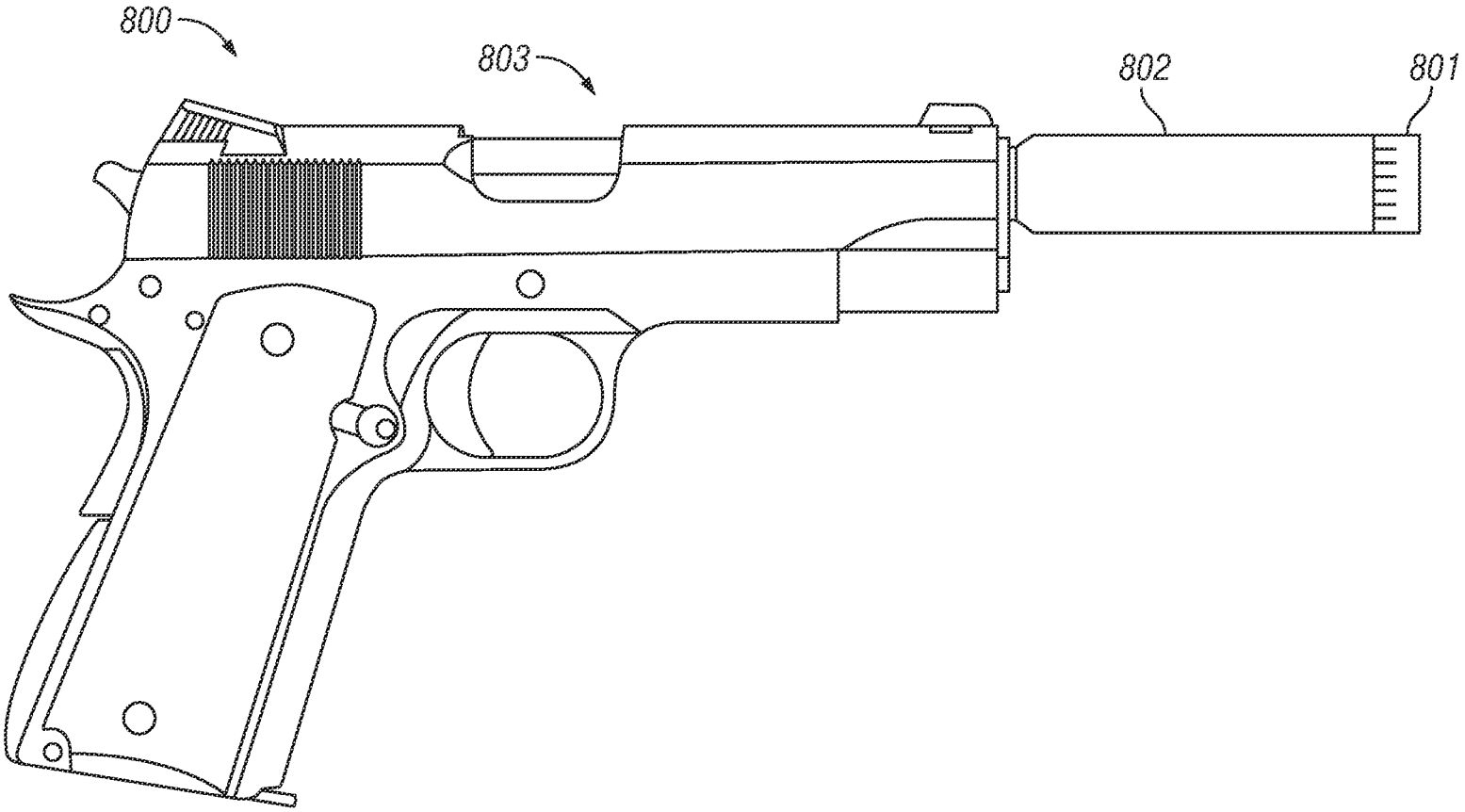
FIG. 3B is an environmental view of a firearm assembly featuring a tuner attached to a suppressor for a pistol.

FIG. 3B is an environmental view of a firearm assembly 800 featuring a tuner 801 attached to a suppressor 802 for a pistol 800. A pistol 803 may have a suppresser 802 attached to the tip of the pistol's 803 barrel. The suppressor 802 may be in line with tuner 801 that is attached at the distal end of the suppressor 802. The suppressor 802 has a pathway that allows for a projectile to traverse the entire longitudinal length of the suppressor, i.e., from the proximate end of the suppressor 802 to the distal end of the suppressor 802. The tuner 801 allows for fine adjustments to the center of gravity of the firearm 803. As depicted in FIG. 3B, the suppressor 802 is in line with the barrel of the pistol 803 in front of the tuner 801. Other embodiments may also include the tuner 801 in line in front of the suppressor 802 such that the tuner 801 is positioned inbetween the suppressor 802 and the barrel of the pistol 803.

In one embodiment of the present disclosure, the tuner 801 may be affixed to the end of a suppressor 802. Generally, any type of suppressor 802 known to one of ordinary skill in the art could be utilized with the tuner 801 described above such as a suppressor 802 that utilizes a baffle stack to dampen the sound of the firing process. Other potential constructions for an embodiment attached to a suppressor 802 include but are not limited to cap-welded, tack-welded, fully welded stack, fully welded, no tube, monocore, etc. At the end of the suppressor 802, an exterior portion may protrude that may have a set of threading along the exterior portion that allows for the tuner to be threaded onto the end of the suppressor 802. Once affixed, the tuner can be adjusted to tune the entire barrel to adjust to the harmonics of the firing process, thereby increasing the accuracy of the firearm while obtaining the benefits of the suppressor 802.

While the embodiments discussed above utilize threading to connect the tuner 801 to the suppressor 802, any other method known by one of ordinary skill in the art to couple the tuner 801 to the barrel may be utilized. For example, an o-ring may be held in place and subject to a shear force by being positioned in between a shoulder of the cylinder and other shoulder of the tuner 801. As the two shoulders move in opposite directions, both sides of the o-ring may be subject to forces in opposite directions, holding the tuner 801 in connection with the cylinder. Similarly, the self-timing nut and the tuner 801 may be affixed to the attachment by other methods and apparatus known by one of ordinary skill in the art. Further, the size of threading utilized on any of the sets of threads featured in the attachment may vary depending on the type and manufacture of the firearm that the attachment is intended to be attached. The thread size may also differ for the self-timing nut and the tuner 801. Any thread size known by one of ordinary skill in the art for affixing an attachment to the muzzle of a firearm may be utilized. In the figures discussed above, there are eight (8) muzzle ports, four (4) on each sided positioned opposite each other along the exterior of the attachment. The number of muzzle ports can be increased or decreases and repositioned depending on the needs of the operator. The specific tuning required to find the "sweet spot," the ideal tuning position that limits the frequency error of the firing process, may vary depending on the firearm, caliber of ammunition used, length of the barrel, additional attachments, and other factors.

While this disclosure has been particularly shown and described with reference to preferred embodiments, it will be understood by those skilled in the art that various changes in form and detail may be made therein without departing from the spirit and scope of the invention. The investors expect skilled artisans to employ such variations as appropriate, and the inventors intend the invention to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

While various embodiments in accordance with the principles disclosed herein have been described above, it should be understood that they have been presented by way of example only and not limitation. Thus, the breadth and scope of this disclosure should not be limited by any of the above-described exemplary embodiments but should be defined only in accordance with any claims and their equivalents issuing from this disclosure. Furthermore, the above advantages and features are provided in described embodiments but shall not limit the application of such issued claims to processes and structures accomplishing any or all of the above advantages.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically, and by way of example, although the headings refer to a "Technical Field," the claims should not be limited by the language chosen under this heading to describe the so-called filed. Further, a description of a technology as background information is not to be construed as an admission that certain technology is prior art to any embodiments) in this disclosure. Neither is the "Brief Summary" to be considered as a characterization of the embodiments(s) set forth in issued claims. Furthermore, any reference in this disclosure to "invention" in the singular should not be used to argue that there is only a single point of novelty in this disclosure. Multiple embodiments may be set forth according to the limitations of the multiple claims issuing from this disclosure, and such claims accordingly define the embodiment(s), and their equivalents, that are protected thereby. In all instances, the scope of such claims shall be considered on their own merits in light of this disclosure but should not be constrained by the headings set forth herein.

I claim:

1. A muzzle brake for a firearm comprising:

a cylinder, wherein the cylinder houses a bore that allows traversal through the entire longitudinal length of the cylinder, wherein the cylinder further comprises one or more muzzle ports positioned along an exterior circumference of the cylinder;

a first threading located on a first end of the cylinder, wherein the first threading traverses at least a portion of the circumference of the first end and is configured to affix a self-timing nut to the cylinder;

an interior threading, wherein the interior threading is located at the first end of the cylinder and is configured to affix the muzzle brake to a firearm;

the self-timing nut is configured to secure the muzzle brake to the firearm and orient the cylinder;

a second threading located on a second end of the cylinder, wherein the second end is on the opposite end of the cylinder from the first end, wherein the second threading traverses at least a portion of the circumference of the second end and configured to affix a tuner to the cylinder; and the tuner is configured to be rotated radially, which adjusts the length and weight of the muzzle brake.

2. The muzzle brake of claim 1, wherein the firearm is a pistol.

3. The muzzle brake of claim 1, wherein the firearm is a rifle.

4. The muzzle brake of claim 1, wherein the muzzle ports are configured radial around the circumference of the muzzle brake so that gas is vented generally and not in any one or more specific directions.

5. The muzzle brake of claim 1, wherein the muzzle ports are configured horizontally along the muzzle brake so that gas is vented in a specific direction.

6. A muzzle brake for a firearm comprising:

a cylinder, wherein the cylinder houses a bore that allows traversal through the entire longitudinal length of the cylinder;

a first threading located on a first end of the cylinder, wherein the first threading traverses at least a portion of the circumference of the first end and is configured to affix a self-timing nut to the cylinder;

the cylinder having an interior threading, wherein the interior threading is configured to affix the cylinder to a firearm;

a second threading located on a second end of the cylinder, wherein the second end is on the opposite end of the cylinder from the first end, and wherein the second threading traverses at least a portion of the circumference of the second end and configured to affix a tuner to the cylinder; and the tuner is configured to be rotated radially, which adjusts the length and weight of the muzzle brake.

7. The muzzle brake of claim 6, wherein the cylinder further comprises one or more muzzle ports positioned along an exterior circumference of the cylinder.

8. The muzzle brake of claim 6, wherein the interior threading is located at the first end of a cylinder; and wherein the self-timing nut is configured to secure the muzzle brake to the firearm and orient the cylinder.

9. The muzzle brake of claim 6, wherein the interior threading is located at the first end of the cylinder, and wherein the tuner is configured to secure the muzzle brake to the firearm and the self-timing nut is configured to orient the cylinder.

10. The muzzle brake of claim 6, wherein the firearm is a pistol.

11. The muzzle brake of claim 6, wherein the firearm is a rifle.

12. The muzzle brake of claim 6, wherein the muzzle ports are configured radially around the circumference of the muzzle brake so that gas is vented generally and not in any one or more specific directions.

13. The muzzle brake of claim 6, wherein the muzzle ports are configured horizontally along the muzzle brake so that gas is vented in a specific direction.

14. An attachment for a firearm comprising:

a sound suppressor having a pathway that allows traversal through the entire longitudinal length of the sound suppressor, and wherein the sound suppressor is configured to be attached to a firearm at a proximate end of the sound suppressor;

the sound suppressor having a distal threading located on a distal end, wherein the distal end is on the opposite end of the suppressor from the proximate end, wherein the distal threading radially traverses at least a portion of the circumference of the distal end and configured to affix a tuner to the suppressor opposite the firearm; and the tuner is configured to be rotated radially, which adjusts the length and weight of the attachment.

15. The attachment for a firearm of claim 14, wherein the sound suppressor incorporates a baffle stack to dampen the sound of the firing process.

16. The attachment for a firearm of claim 14, wherein the type of sound suppressor is selected from a group consisting of the following: cap-welded, tack-welded, fully welded stack, fully welded, no tube, and monocore.

17. The attachment for a firearm of claim 14, wherein the firearm is a pistol.

18. The attachment for a firearm of claim 14, wherein the firearm is a rifle.

19. The attachment for a firearm of claim 14 further comprising:

a self-timing nut inline with the sound suppressor and the tuner.

20. The attachment for a firearm of claim 19, wherein the self-timing nut is located on the proximate end of the sound suppressor, and wherein the self-timing nut is configured to secure the sound suppressor to the firearm and orient the attachment.

* * * * *